United States Patent [19]

McClellan

[11] Patent Number: 4,836,425

[45] Date of Patent: Jun. 6, 1989

[54] HANDGUN HOLDER

[76] Inventor: Gary C. McClellan, 4011 Saddler La., Vale, Oreg. 97918

[21] Appl. No.: 153,771

[22] Filed: Feb. 8, 1988

[51] Int. Cl.[4] ..... A45C 11/00

[52] U.S. Cl. ..... 224/163; 224/249; 224/271; 224/912

[58] Field of Search ..... 224/163, 912, 243, 191, 224/192, 249, 271, 198; 42/1.09, 71.02

[56] References Cited

U.S. PATENT DOCUMENTS

| | | | |
|---|---|---|---|
| 1,222,264 | 4/1917 | Cabanne | 224/912 X |
| 4,310,111 | 1/1982 | Brent | 224/271 X |
| 4,450,992 | 5/1984 | Casull | 224/912 X |

*Primary Examiner*—Renee S. Luebke
*Attorney, Agent, or Firm*—Paul F. Horton

[57] ABSTRACT

A plate for holding a handgun of the type having a retention stud and clip, said plate comprising a keyhole slot for receiving the stud and a clip opening for receiving the clip. A groove on the front face of the plate guides the clip into the clip opening simultaneously with the reception of the stud by the keyhole slot, upon lateral movement of the handgun relative to the plate. The clip, and hence the handgun, is held firmly against the plate by a cantilever spring mounted on the back face of the plate. A shoulder, defined by the clip opening and groove, causes the clip to snap in place to prevent accidental removal of the handgun from the plate. The plate may be either free standing, hung like a picture frame, or may include a buckle and latch pin for mounting upon a belt to define a handgun holding belt buckle.

8 Claims, 2 Drawing Sheets

HANDGUN HOLDER

BACKGROUND OF THE INVENTION

1. Field of the Invention

This invention relates, in general, to handgun holders and more particularly to a plate for holding handguns.

2. Description of the Prior Art

Handguns of the type having clip fasteners are known in the art as typified by U.S. Pat. No. 1,266,633, issued to G. A. Sachs and U.S. Pat. No. 4,689,908, issued to the present inventor, G. C. McClellan. Handguns having retention studs are also known, being typified by U.S. Pat. No. 252,448, issued to L. S. Flatau and U.S. Pat. No. 4,450,992, issued to R. J. Casull.

For reasons of safety, for display, and for storage, it is desirable to have a handgun holder. A plate type holder is particularly desirable in that when in place the handgun is ordinarily rendered inoperable and therefore safe. A plate further provides an excellent background for display and a plate is readily movable and with only slight modification can be made into a belt buckle. The belt buckle is especially adapted for miniature handguns.

R. J. Casull utilizes a plate as a belt buckle. The Casull device requires the plate to have an indentation in the shape of the gun and is therefore useable only with a handgun of certain size and shape. The indentations or cut-outs cooperate with a spring loaded stud holder to hold the handgun in place. A release mechanism must also be provided for removing the spring from the stud.

B. D. Bockover, U.S. Pat. No. 4,377,249, utilizes a cover in cooperation with spaced spring clips for holding the gun to a plate. Other relevant inventions include those of S. Leaver, U.S. Pat. No. 4,260,087 and J. Ryan, U.S. Pat. No. 3,026,642.

SUMMARY OF THE INVENTION

The present invention is a plate for holding handguns of the type provided with a retention stud and a retention clip, said plate including a keyhole slot for receiving the stud and a laterally spaced clip opening provided with a grooved guide for receiving the clip, whereby a handgun may be readily and securely mounted on the plate by inserting the stud into the keyhole and the clip into the clip opening and moving the handgun laterally in relationship to the plate to lock the handgun in place by a cantilever spring and whereby the gun may be removed from the plate by reversing the procedure. A more complete description of the device may be found in the appended claims.

DETAILED DESCRIPTION OF THE INVENTION

Figure 1:
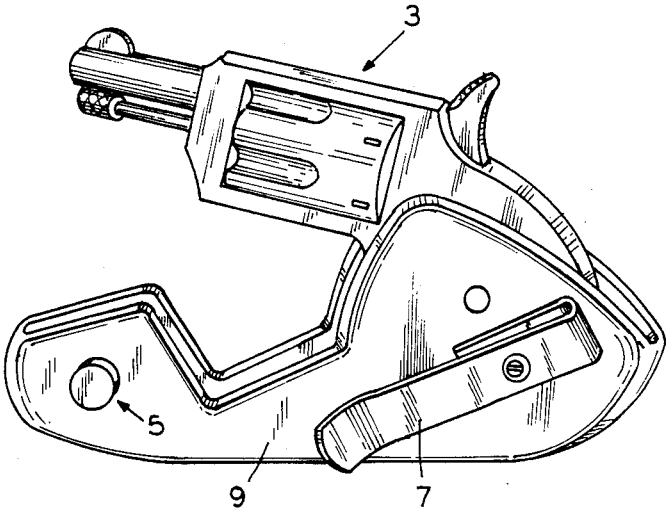
FIG. 1 is a perspective view of an existing handgun provided with a retention stud and clip, both of which are mounted on the holster-handgrip extension of the gun. The gun is shown in a partially open position.
Figure 2:
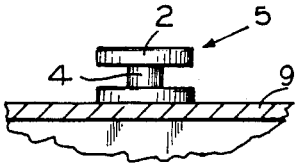
FIG. 2 is a side elevation of the retention stud.

Referring to the drawings and FIG. 1 in particular, a handgun 3 having a retention stud 5 and a retention clip 7 is shown. The particular handgun shown includes a holster-handgrip extension, designated by the numeral 9 and is shown and described in my disclosure, U.S. Pat. No. 4,689,908, but it is obvious that other handguns provided with a retention stud and clip may be used with my handgun holder described herein. Stud 5, shown in FIG. 2, is conventional in form, having a circular head portion 2 and a restricted neck portion 4; the neck portion being of lesser diameter than the head portion. Laterally spaced clip 7 is also conventional, being in the form of a resilient cantilever having an abutment 8, the use of which will hereinafter be explained.

Figure 3:
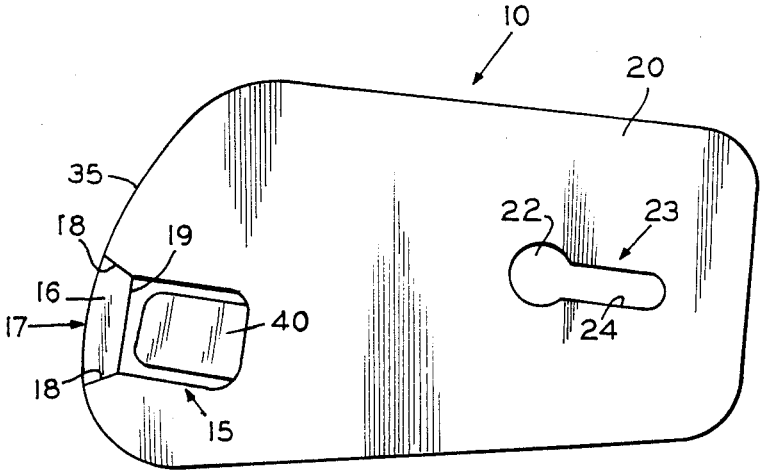
FIG. 3 is a plan view of the front face of the handgun holding plate of the present invention.
Figure 4:
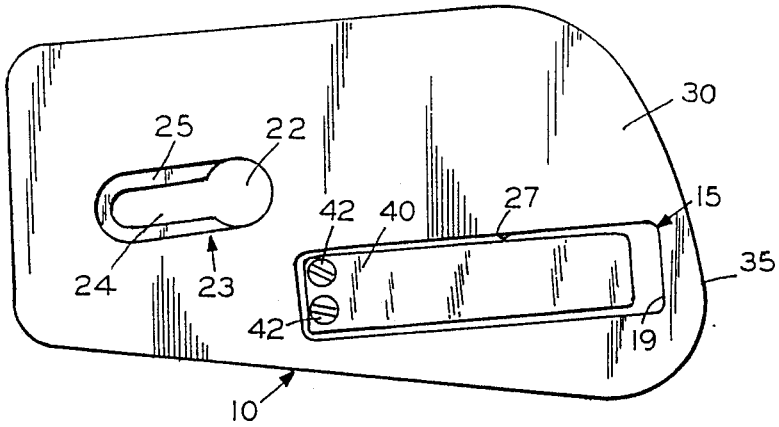
FIG. 4 is a plan view of the back face of the plate shown in FIG. 3.

Now referring to FIGS. 3 and 4, one preferred embodiment of a handgun holding plate 10 made according to the present invention is disclosed. The plate may be mounted on a supporting base, not shown; may be hung in the manner of a picture; or may be attached to a belt and worn as a belt buckle. The plate may be constructed of any suitable material. High impact plastic, aluminum, or stainless steel is the preferred material for construction. Plate 10 has opposing parallel and substantially planar sides, front face 20 and back face 30.

Machined, molded, or otherwise formed on the front face of plate 10 for reception of stud 5 of the handgun 3 is a keyhole slot 23. The keyhole slot may or may not open completely through the plate. The slot is provided with a circular opening 22 for reception of head 2 of stud 5 and includes a longitudinal opening 24 of lesser width for receiving neck 4 of the stud when the stud is slipped into the openings. Longitudinal opening 24 is provided with a shoulder 25, shown to advantage in FIG. 4, for engaging the back of the head for retention of the stud.

Formed through plate 10 for receiving clip 7 of the handgun is clip opening 15. Also provided to work in cooperation with the clip opening is a first groove 17, formed on the front face 20 of the plate. Groove 17 is used for guiding the clip into the clip opening. The groove is parallel with longitudinal opening 24 of keyhole slot 23 and extends from edge 35 of the plate to opening 15. The groove includes a flat base 16 and a pair of side walls 18. A shoulder 19 is defined by the plate at the juncture of groove 17 and clip opening 15.

Mounted on back face 30 of the plate so as to extend into clip opening 15 is a cantilever spring 40. Spring 40 may be constructed of either spring metal or resilient plastic and is preferably mounted in a second groove 27 which is in alignment with the first groove 17. The base of each of the grooves are preferably coplanar with one another so that spring 40, which is held in place by a pair of screws 42, may be depressed from the back face toward the front face so as to engage the undersurface of clip 7 as will be explained.

Figure 6:
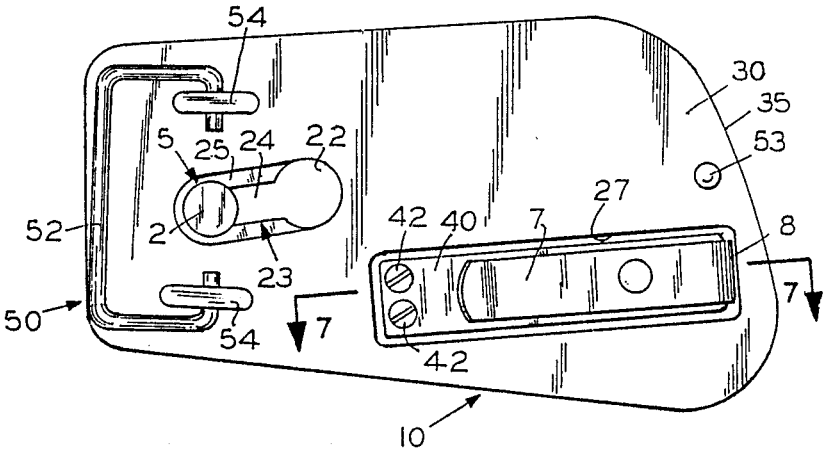
FIG. 6 is a plan view of the back face of a second embodiment of the handgun plate, showing attachments for a belt and showing the handgun in a mounted position.
Figure 7:
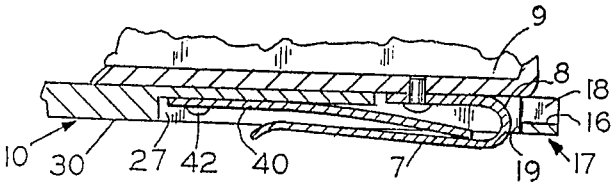
FIG. 7 is a partial section along lines 7—7 of FIG. 6.

Referring to FIG. 6 and 7, a second embodiment of plate 10 is shown. This plate may be identical to the plate shown in the first embodiment except for including belt attachment means, designated generally by the numeral 50. Attachment means 50 includes a pivoted loop member 52 and a belt pin 53. Loop member 52 is pivotally mounted to back face 30 of plate 10 by means of a pair of pivot brackets 54 formed on or welded to the plate. One end of a belt engages loop member 52 and the other end of the belt, after extending about the wearer, engages pin 53 in one of several belt holes. Obviously, other types of belt fasteners may be employed.

Figure 5:
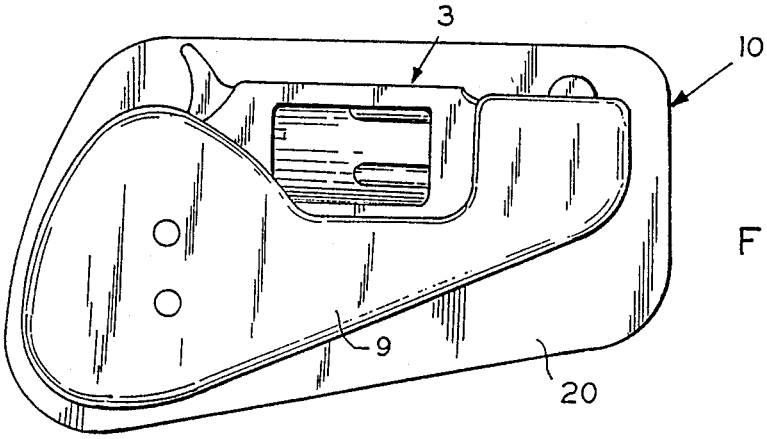
FIG. 5 is a plan view of the front face of the handgun plate showing the handgun in a mounted position.

To attach handgun 3, shown in FIG. 1, to front face 20 of plate 10, cantilever spring 40 is first depressed from the back side of the plate toward the front face. Clip 7 of the handgun is then placed into first groove 17 and the handgun moved laterally to force the clip through clip opening 15 with the underside of the clip in contact with the back surface of the spring. Further lateral movement of the handgun relative to plate 10 brings head 2 of stud 5 into registry with circular opening 22 of keyhole slot 23. Head 2 is then inserted through opening 22 and further lateral movement of the handgun, in the same direction, results in neck 4 of the stud being received within the longitudinal opening 24 of the keyhole slot and head 2 of the stud being held in place by shoulder 25 of the slot. Simultaneously, the lateral movement of the handgun causes clip 7 to slide along the back surface of spring 40 until abutment 8 of clip 7 slips over shoulder 19 of the plate to snap the clip into place, as may be seen to advantage in FIG. 6. It is to be noted that first groove 17 and longitudinal opening 24 of keyhole slot 23 in being parallel with one another and first groove 17 and second groove 27 in being aligned with one another, cooperate to guide stud 5 and clip 7 into place to provide two retention points for holding the handgun to the plate. Abutment 8 may be a defined portion of the clip resulting from the clip being bent back upon itself or, where the clip does not have such a bend, may be otherwise formed on the clip. Once mounted, the handgun is held in place as shown in FIG. 5. To remove the handgun from the plate, the end of the handgun to which the clip is attached is simply pulled outwardly to overcome the force exerted on the clip by spring 40 and the handgun is pulled laterally to remove stud 5 from the keyhole slot and clip 7 from opening 15 of the plate.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A handgun holding plate for handguns having a retention stud and clip, said plate comprising:

a slot formed on a front face of said plate for receiving and retaining the stud;

a clip opening through said plate for insertion of the clip therethrough;

a first groove formed on the front face of said plate between said clip opening and one edge of said plate for guiding the clip through said clip opening; and a spring mounted on a back side of said plate, said spring operable to engage the clip for holding the clip and hence the handgun in firm contact against said plate.

2. The plate as described in claim 1 wherein said spring is a cantilever spring.

3. The plate as described in claim 1 wherein said clip opening and said groove define a retention shoulder in said plate.

4. The plate as described in claim 3 further comprising a second groove formed on the back face of said plate for receiving said cantilever spring, said second groove in alignment with said first groove so that said cantilever spring may be depressed toward the front face of said plate to a position above the base of said first groove.

5. The plate as described in claim 1 further comprising belt attachment means to define a belt buckle.

6. A handgun holding plate for handguns provided with a retention stud having a restricted neck portion and an expanded head portion and further provided with a clip, said plate comprising:

a keyhole slot, having a head opening and a longitudinally extending neck opening, formed on a front face of said plate for receiving and retaining said stud;

a clip opening through said plate for insertion of the clip therethrough;

a first groove formed on the front face of said plate between said clip opening and one edge of said plate for guiding the clip through said opening, said first groove being parallel with said longitudinally extending neck opening of said keyhole slot whereby said stud is received within said keyhole slot simultaneously with the reception of said clip in said clip opening upon lateral movement of the handgun relative to said plate;

a second groove formed on a back face of said plate in alignment with said first groove; and a cantilever spring mounted on the back face of said plate within said second groove for engaging the clip to hold the clip and hence the handgun in firm contact against said plate.

7. The plate as described in claim 6 wherein said clip opening and said first groove define a shoulder operable to engage said clip to prevent lateral movement thereof.

8. The plate as described in claim 6 further comprising belt attachment means for defining a belt buckle.

* * * * *